US009129507B2

(12) United States Patent
Lee

(10) Patent No.: US 9,129,507 B2
(45) Date of Patent: Sep. 8, 2015

(54) PORTABLE ELECTRICAL APPARATUS AND METHOD FOR DETECTING STATE OF THE SAME

(71) Applicant: ACCTON TECHNOLOGY CORPORATION, Hsinchu (TW)

(72) Inventor: Tsung-Hsueh Lee, Taoyuan County (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 173 days.

(21) Appl. No.: 13/831,554

(22) Filed: Mar. 14, 2013

(65) Prior Publication Data

US 2013/0278417 A1 Oct. 24, 2013

(30) Foreign Application Priority Data

Apr. 23, 2012 (TW) ..... 101114392 A

(51) Int. Cl.
*G08B 1/00* (2006.01)
*G08B 21/04* (2006.01)

(52) U.S. Cl.
CPC ..... *G08B 21/0446* (2013.01); *G08B 21/043* (2013.01)

(58) Field of Classification Search
USPC ..... 340/539.13, 539.14, 539.15, 539.16, 340/539.17, 539.18, 539.21, 539.23, 441; 701/419, 491, 533
See application file for complete search history.

(56) References Cited

U.S. PATENT DOCUMENTS

| | | | | |
|---|---|---|---|---|
| 4,485,338 | A * | 11/1984 | Matsuura et al. | 318/569 |
| 4,504,772 | A * | 3/1985 | Matsuura et al. | 318/603 |
| 4,679,139 | A * | 7/1987 | Durbin | 1/1 |
| 6,523,093 | B1 * | 2/2003 | Bogin et al. | 711/137 |
| 6,661,347 | B2 | 12/2003 | Lehrman et al. | |
| 6,975,941 | B1 * | 12/2005 | Lau et al. | 701/491 |
| 2005/0004754 | A1 * | 1/2005 | Hayes | 701/209 |
| 2005/0264404 | A1 * | 12/2005 | Franczyk et al. | 340/441 |
| 2007/0276594 | A1 * | 11/2007 | Tramel | 701/209 |
| 2008/0155275 | A1 * | 6/2008 | Natarajan et al. | 713/193 |
| 2010/0064259 | A1 * | 3/2010 | Alexanderovitc et al. | 715/852 |
| 2010/0298742 | A1 | 11/2010 | Perlman et al. | |
| 2011/0040724 | A1 * | 2/2011 | Dircz | 707/603 |

(Continued)

FOREIGN PATENT DOCUMENTS

| | | | |
|---|---|---|---|
| CN | 1531313 | A | 9/2004 |
| CN | 101650869 | A | 2/2010 |

(Continued)

*Primary Examiner* — Paul Obiniyi
(74) *Attorney, Agent, or Firm* — CKC & Partners Co., Ltd.

(57) ABSTRACT

A portable electrical apparatus includes a sensor, a micro-controller, and a wireless positioning module. The sensor is configured for sensing a movement of the portable electrical apparatus to generate a sensing signal. The micro-controller is configured for receiving the sensing signal and comparing a threshold value with a sensing value corresponding to the sensing signal. The wireless positioning module is configured for positioning the portable electrical apparatus to generate a plurality of position data corresponding to a location of the portable electrical apparatus. When the sensing value is greater than the threshold value, the micro-controller loads the position data generated within a predetermined period, which is right after the sensing value being greater than the threshold value, compares the loaded position data with each other, and an alarm signal is sent out according to a comparison result.

9 Claims, 2 Drawing Sheets

(56) References Cited

U.S. PATENT DOCUMENTS

| | | | | |
|---|---|---|---|---|
| 2011/0199216 | A1 | 8/2011 | Flinsenberg et al. | |
| 2012/0032877 | A1 * | 2/2012 | Watkins et al. | 345/156 |
| 2012/0036485 | A1 * | 2/2012 | Watkins et al. | 715/863 |
| 2012/0194873 | A1 * | 8/2012 | Fu et al. | 358/448 |

FOREIGN PATENT DOCUMENTS

| | | | | | |
|---|---|---|---|---|---|
| CN | 201902236 | U | | 7/2011 | |
| JP | 02291098 | A | * | 11/1990 | G08G 1/0968 |
| JP | 2000081912 | A | * | 3/2000 | G05D 3/12 |
| WO | WO 03032003 | A2 | * | 4/2003 | |

* cited by examiner

PORTABLE ELECTRICAL APPARATUS AND METHOD FOR DETECTING STATE OF THE SAME

RELATED APPLICATIONS

This application claims priority to Taiwan Application Serial Number 101114392, filed Apr. 23, 2012, which is herein incorporated by reference.

BACKGROUND

1. Field of Invention

The present invention relates to an electrical apparatus and a detecting method of the same. More particularly, the present invention relates to a portable electrical apparatus and a method for detecting a state of the same.

2. Description of Related Art

People with disabilities face difficulties with movement and are slow to react, and as a result, may fall down easily. Therefore, ascertaining the state of people with disabilities in real time so as to provide help when they are in need is an important task in the field of home care.

A traditional care system is passive, meaning that a user is required to send out a distress signal by pressing a communication button or by using an intercom. However, when a person is in an emergency situation, such as that encountered after having fallen down or passed out, he/she may not be able to send out a distress signal in such a manner. Therefore, the safety of people with disabilities cannot be ensured through such a passive care system.

SUMMARY

The present invention is related to a portable electrical apparatus and a method for detecting the state of the same, to help users send out an alarm signal when they fall down, are struck suddenly by an object, etc.

In an aspect of the invention, a portable electrical apparatus is provided, which includes a sensor, a micro-controller, and a wireless positioning module. The sensor is configured for sensing a movement of the portable electrical apparatus to generate a sensing signal. The micro-controller is configured for receiving the sensing signal and comparing a threshold value with a sensing value corresponding to the sensing signal. The wireless positioning module is coupled to the micro-controller, and is configured for performing localization of the portable electrical apparatus to generate a plurality of position data corresponding to a location of the portable electrical apparatus. When the sensing value is greater than the threshold value, the micro-controller loads the position data generated within a predetermined period starting from right after the sensing value is greater than the threshold value, and compares the loaded position data with each other. An alarm signal is sent out according to a comparison result.

According to one embodiment of the present invention, when the micro-controller determines that all the loaded position data are the same, the wireless positioning module sends out the alarm signal.

According to one embodiment of the present invention, when the micro-controller determines that all the loaded position data are the same, the micro-controller sends out the alarm signal to the wireless positioning module.

According to one embodiment of the present invention, when the micro-controller determines that at least half of the loaded position data are the same, the micro-controller sends out the alarm signal to the wireless positioning module.

According to one embodiment of the present invention, the sensor is an accelerometer, and the wireless positioning module is a ZigBee® wireless positioning module.

In another aspect of the present invention, a method for detecting the state of a portable electrical apparatus is provided. Localization of the portable electrical apparatus is performed to generate a plurality of position data corresponding to a location of the portable electrical apparatus. A movement of the portable electrical apparatus is sensed to generate a sensing signal A threshold value and a sensing value corresponding to the sensing signal are compared. When the sensing value is greater than the threshold value, the position data generated within a predetermined period are loaded, in which the predetermined period starts right after the sensing value is greater than the threshold value. The loaded position data are compared with each other. An alarm signal is sent out when the loaded position data are the same.

According to one embodiment of the present invention, the detecting method further includes the step of continuing to perform localization of the portable electrical apparatus when at least two loaded position data are different.

According to one embodiment of the present invention, the detecting method further includes the step of sending out the alarm signal when at least half of the loaded position data are the same or part of the loaded position data are the same.

In still another aspect of the present invention, a method for detecting the state of a portable electrical apparatus is provided. The portable electrical apparatus is turned on. Localization of the portable electrical apparatus is performed to generate a plurality of position data corresponding to a location of the portable electrical apparatus. A movement of the portable electrical apparatus is sensed to generate a sensing signal. A threshold value and a sensing value corresponding to the sensing signal are compared. When the sensing value is greater than the threshold value, the position data generated within a predetermined period are loaded, in which the predetermined period starts right after the sensing value is greater than the threshold value. The loaded position data are compared with each other. An alarm signal is sent out when the loaded position data are the same. A radio frequency signal corresponding to the alarm signal is sent out. A warning signal corresponding to the radio frequency signal is sent out.

According to one embodiment of the present invention, the alarm signal is sent out when at least half of the loaded position data are the same or part of the position data are the same.

In summary, by utilizing the embodiments mentioned above, a detection of when a user falls down, is struck suddenly by an object, etc. can be performed, and this can be realized accurately so that an alarm signal is not sent out erroneously due to an incorrect judgment by the portable electrical apparatus. In addition, when an accident occurs, the alarm signal can be sent to family members of the user and/or a care center, such that others can be notified of the emergency situation of the user.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
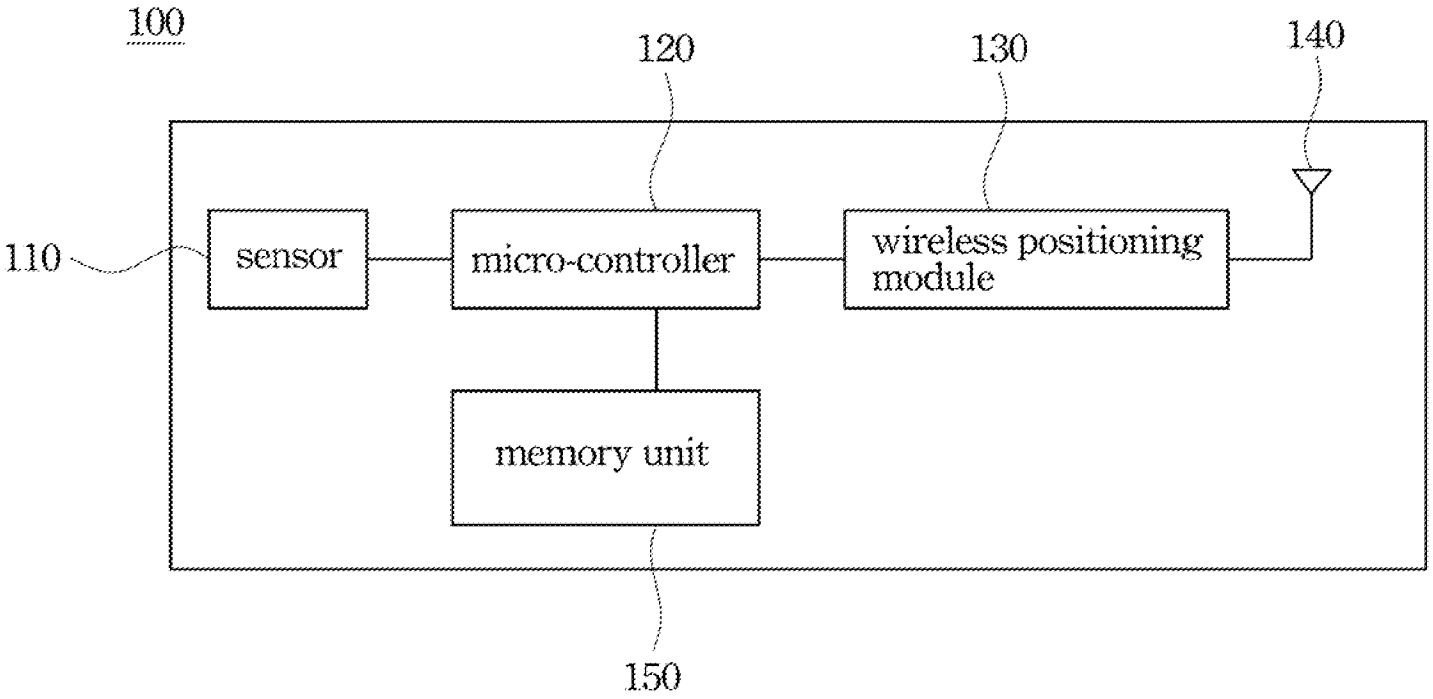
FIG. 1 is a block diagram of a portable electrical apparatus according to an embodiment of the present invention.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

FIG. 1 is a block diagram of a portable electrical apparatus according to an embodiment of the present invention. The portable electrical apparatus 100 includes a sensor 110, a micro-controller 120, a wireless positioning module 130, and an antenna 140. The sensor 110 is coupled to the micro-controller 120, for generating a sensing signal. The micro-controller 120 is coupled to the wireless positioning module 130, for receiving position data generated by the wireless positioning module 130. The antenna 140 is coupled to the wireless positioning module 130, for receiving and transmitting radio signals.

The sensor 110 is configured to sense the movement of the portable electrical apparatus 100, for generating the sensing signal. When a user takes along the portable electrical apparatus 100 with him/her, the sensor 110 senses the displacement and the velocity of the portable electrical apparatus 100, and correspondingly generates the sensing signal. In this embodiment, the sensor 130 can be an accelerometer for sensing the movement of the portable electrical apparatus 100 and generating an acceleration sensing signal. However, the sensor 110 is not limited to being an accelerometer, that is, one skilled in the art can select any type of sensor.

The wireless positioning module 130 is configured to perform localization of the portable electrical apparatus 100 and generate the position data. The localization can be performed by various kinds of wireless communication techniques, and the radio frequency signals for delivering information or for performing control can be received or transmitted through the antenna 140. In practice, the wireless positioning module 130 can be a ZigBee® wireless positioning module, a Bluetooth wireless positioning module, an ultra-wide band (UWB) wireless positioning module, or a radio frequency identification (RFID) wireless positioning module.

For example, if the wireless positioning module 130 is realized by a ZigBee® wireless positioning module, then a wireless radio frequency circuit is configured inside the ZigBee® wireless positioning module, and a plurality of ZigBee® sensors are disposed in a living space. The ZigBee® wireless positioning module sends out radio frequency signals to each ZigBee® sensor in the living space, and each ZigBee® sensor detects the position of the portable electrical apparatus 100 and then returns a positioning radio frequency signal back to the ZigBee® wireless positioning module, such that the ZigBee® wireless positioning module can accordingly generate ZigBee® position data. With the ZigBee® position data, the position of the portable electrical apparatus 100 can be determined, that is, the position of the user who takes along the portable electrical apparatus 100 with him/her can be determined. In practice, the ZigBee® wireless positioning module can position the portable electrical apparatus 100 through received signal strength indications (RSSI), link quality indications (LQI), or the transmitting power of signals.

The micro-controller 120 is configured to receive the sensing signal and compare a threshold value with a sensing value corresponding to the sensing signal. As an example, the sensing value can be an acceleration of the portable electrical apparatus 100. When the sensing value is greater than the threshold value, the micro-controller 120 loads the position data generated by the wireless positioning module 130 within a predetermined period, such as 60 seconds or 120 seconds, in which the predetermined period is started right after the moment when the sensing value greater than the threshold value. Subsequently, the micro-controller 120 compares the loaded position data with each other through a comparison process, and according to the comparison result determines whether to send out an alarm signal.

For example, in the case where the sensor 110 is an accelerometer and the wireless positioning module 130 is a ZigBee® wireless positioning module, whenever a user who takes along the portable electrical apparatus 100 with him/her moves, the accelerometer generates the acceleration sensing signal. When the sensing value corresponding to the acceleration sensing signal is greater than the threshold value, the micro-controller 120 collects the position data generated by the ZigBee® wireless positioning module within a predetermined time starting after the sensing value is greater than the threshold value, and compares the collected position data. According to the comparison of the position data, the micro-controller 120 determines whether the sensing value being greater than the threshold value is due to a situation in which the user has fallen down, has been struck suddenly by an object, etc., and sends out an alarm signal when it is determined that the user has fallen down, has been struck suddenly by an object, etc. In this manner, an alarm signal is not sent out erroneously due to an incorrect judgment by the portable electrical apparatus 100.

In some embodiments, when the micro-controller 120 determines that all the loaded positioning data are the same, the micro-controller 120 sends out the alarm signal. That is, after the micro-controller 120 determines that the sensing value corresponding to the sensing signal is greater than the threshold value, if the user remains at the same place within a predetermined period, the position data generated by the wireless positioning module 130 are the same for example, the position data at the beginning and the end of the predetermined period are the same). When this occurs, the micro-controller 120 sends out the alarm signal to the wireless positioning module 130, and as a result, the wireless positioning module 130 sends out a wireless radio frequency signal corresponding to the alarm signal through the antenna 140. In this manner, when the user falls down, is struck suddenly by an object, etc. and is unable to move, the alarm signal will be sent out automatically, such that notification of the emergency condition of the user can be provided.

Furthermore, after receiving the alarm signal, the wireless positioning module 130 can send out a radio frequency signal corresponding to the alarm signal to a server through the antenna 140, and the server will send a warning signal to the Internet, so as to inform family members of the user and/or a care center that an emergency has occurred.

In another embodiment of the present invention, when the micro-controller 120 determines that all the loaded position data are the same, the wireless positioning module 130 sends out the alarm signal. That is, after the micro-controller 120 determines that the sensing value corresponding to the sensing signal is greater than the threshold value, if the user remains at the same place within a predetermined period, the position data generated by the wireless positioning module 130 are the same (for example, the position data at the beginning and the end of the predetermined period are the same). When this occurs, the micro-controller 120 instructs the wireless positioning module 130 to send out the alarm signal, and then the wireless positioning module 130 sends out a wireless radio frequency signal corresponding to the alarm signal through the antenna 140. In this manner, when the user falls down, is struck suddenly by an object, etc. and is unable to move, the alarm signal will be sent out automatically, and as a result, notification of the emergency condition of the user can be provided.

In this embodiment, the micro-controller 120 can determine whether the position data are the same with a tolerance range of data comparison, in which the tolerance range of data comparison refers to an allowable difference between position data when the micro-controller 120 performs the determination of whether the position data are the same. As a result, the determination by the micro-controller 120 is not adversely affected by various factors (such as, temperature or humidity) which would cause that the micro-controller 120 to receive different position data when the user is actually at the same place. For example, when most of the loaded position data loaded by the micro-controller 120 are the same, that is, only one or a few loaded position data are different from the other loaded position data, due to the tolerance range of data comparison, the micro-controller 120 will determine that the position of the user within the predetermined period is the same, and the micro-controller 120 will send out the alarm signal to the wireless positioning module 130, which may be a ZigBee® wireless positioning module as described above.

Therefore, due to the tolerance range of data comparison, when some of the position data loaded by the micro-controller 120 are the same (for example, 60% of loaded position data are the same), the micro-controller 120 may determine that the position of the user within a predetermined period is the same, and therefore will send out the alarm signal to the wireless positioning module 130. Similarly, in another embodiment, due to the tolerance range of data comparison, when at least half of the position data loaded by the micro-controller 120 are the same, the micro-controller 120 may still send out the alarm signal to the wireless positioning module 130. The tolerance range of data comparison can be determined on the basis of use conditions or actual requirements, and is not limited to the ranges in the above-mentioned embodiments.

When the user moves to another position within the predetermined period, such that at least two position data loaded by the micro-controller 120 are different, the wireless positioning module 130 continues to perform localization of the portable electrical apparatus 100. That is, after the micro-controller 120 determines that the sensing value corresponding to the sensing signal is greater than the threshold value, if the user moves to another position within the predetermined period then at least two position data loaded by the micro-controller 120 are different, so that the micro-controller 120 can determine that the user did not fall down, was struck suddenly by an object, etc. Hence, an alarm signal is not sent out erroneously merely because the sensing value corresponding to the sensing signal is greater than the threshold value.

When the micro-controller 120 determines that the sensing value is smaller than the threshold value, the wireless positioning module 130 continues performing localization of the portable electrical apparatus 100. In other words, a sensing value that is smaller than the threshold value means that the portable electrical apparatus 100 did not move in an irregular manner. Therefore, it can be assumed that the user did not fall down, was struck suddenly by an object, etc., so that the micro-controller 120 will not compare the position data within a predetermined period, and the wireless positioning module 130 will continue performing localization of the portable electrical apparatus 100.

In this embodiment, the portable electrical apparatus 100 can further include a memory unit 150. As shown in FIG. 1, the memory unit 150 is coupled to the micro-controller 120, for storing the position data generated by the wireless positioning module 130 via the micro-controller 120. The micro-controller 120 loads the position data stored in the memory unit 150, so as to compare these position data. In another embodiment, the position data generated by the wireless positioning module 130 can be directly stored in the memory unit 150, and do not pass through the micro-controller 120.

At least two of the sensor 110, the micro-controller 120, the wireless positioning module 130, and the memory unit 150 can be configured into an integrated circuit. For example, the sensor 110, the micro-controller 120, and the wireless positioning module 130 can be configured into a single integrated circuit. In another embodiment, all of the sensor 110, the micro-controller 120, the wireless positioning module 130, and the memory unit 150 can be configured into a single integrated circuit.

Figure 2:
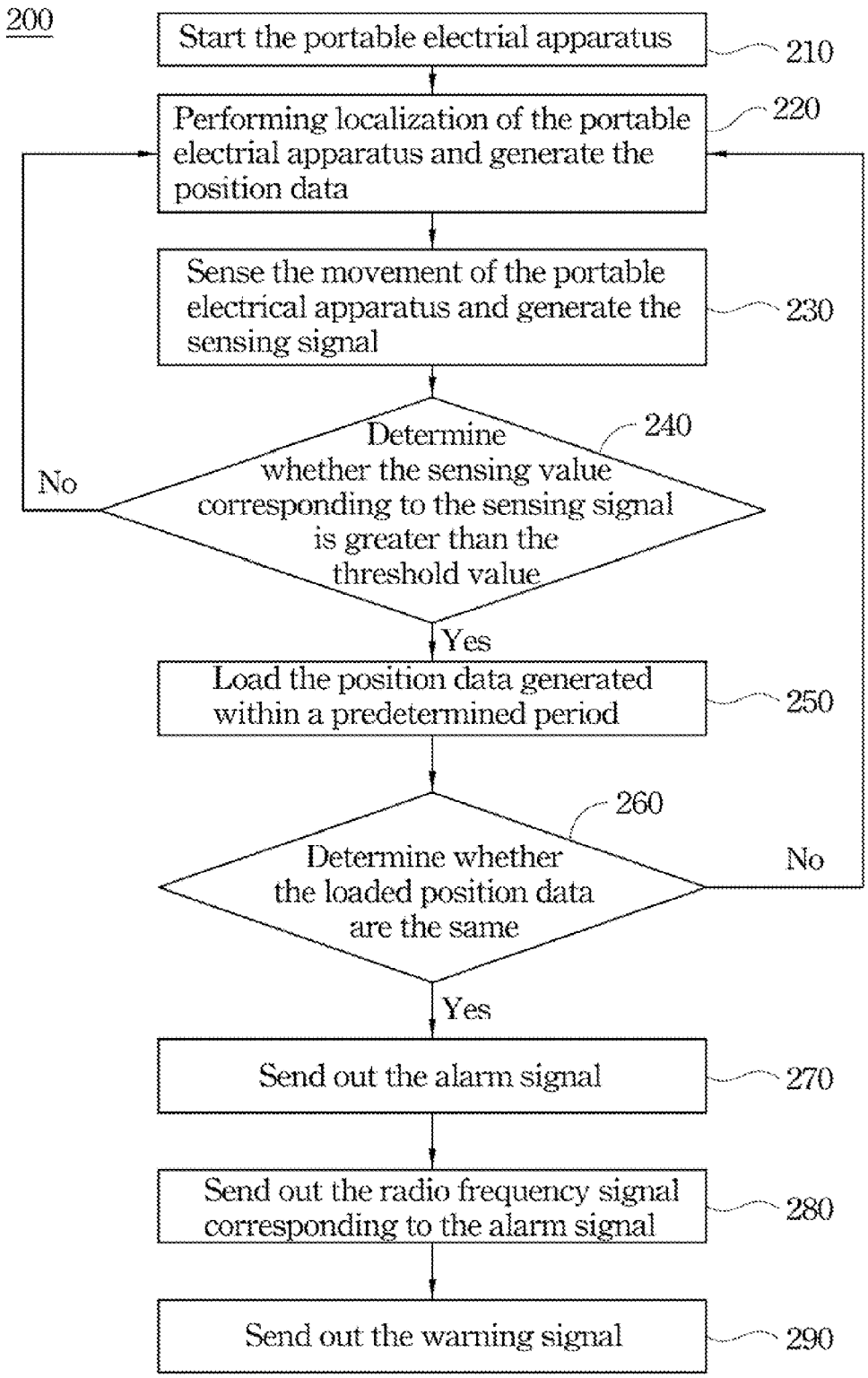
FIG. 2 is a flow chart of a method for detecting a state of a portable electrical apparatus according to an embodiment of the present invention.

FIG. 2 is a flow chart of a method for detecting a state of a portable electrical apparatus according to an embodiment of the present invention. The detecting method 200 can be carried out by the portable electrical apparatus 100 shown in FIG. 1, but is not limited to being carried out by this apparatus. The following description can be more clearly understood by referring to both FIG. 1 and FIG. 2. Moreover, it is noted that the steps in the detecting method 200 are not in any particular order, unless a specific order is stated.

The detecting method 200 includes step 210 to step 290. First of all, in step 210, the portable electrical apparatus 100 is started, so that the state of the portable electrical apparatus 100 can be detected, and by the following steps, the safety of the user who carries the portable electrical apparatus 100 can be ensured.

Next, in step 220, localization of the portable electrical apparatus 100 is performed to generate a plurality of position data corresponding to a location of the portable electrical apparatus 100.

Subsequently, in step 230, a movement of the portable electrical apparatus 100 is sensed to generate a sensing signal. For example, when a user who carries the portable electrical apparatus 100 moves, an acceleration of the portable electrical apparatus 100 can be sensed and a sensing signal is accordingly generated.

Subsequently, in step 240, a threshold value and a sensing value corresponding to the sensing signal are compared to determine whether the sensing value is greater than the threshold value, in which the sensing value can be an acceleration of the portable electrical apparatus 100.

In step 250, when the sensing value is greater than the threshold value, the position data generated within a predetermined period are loaded, and when the sensing value is smaller than the threshold value, the routine returns back to step 220, and localization of the portable electrical apparatus 100 is continually performed. The predetermined period mentioned above may be 60 seconds or 120 seconds or another time period starting right after the moment it is determined that the sensing value is greater than the threshold value. In other words, when the user who takes the portable electrical apparatus 100 along with him/her is moving fast, the sensor 110 correspondingly generates the sensing signal, and when the sensing value of the sensing signal is greater than the threshold value, this may indicate that the user has fallen down, has been struck suddenly by an object, etc. Therefore, at this moment, the micro-controller 120 loads the position data generated by the wireless positioning module 130 within a predetermined period starting from right after the sensing value is greater than the threshold value, and compares the position data. According to the comparison of the position data, the micro-controller 120 determines whether the sensing value being greater than the threshold value is due to a situation in which the user has fallen down, has been struck suddenly by an object, etc., and sends out an alarm signal when it is determined that the user has fallen down, has been struck suddenly by an object, etc. In this manner, an alarm signal is not sent out erroneously due to an incorrect judgment by the portable electrical apparatus 100.

On the other hand, when the sensing value is smaller than the threshold value, this indicates that the user has not fallen down, has been struck suddenly by an object, etc. In this case, the micro-controller 120 will not load or compare the position data generated within the predetermined period. Instead, the routine returns back to step 220, and localization of the portable electrical apparatus 100 is continually performed.

In step 260, the loaded position data are compared with each other to determine if the position of the user is the same. That is, when the sensing value is greater than the threshold value, the micro-controller 120 loads and compares the position data generated within the predetermined period.

In step 270, when the loaded position data are the same, the alarm signal is sent out, and when the loaded position data are different, the routine returns back to step 220, and localization of the portable electrical apparatus 100 is continually performed. With the comparison result in step 260, it can be determined if the position of the user is the same within a predetermined period after the sensing value is greater than the threshold value, such that an alarm signal can be sent out when the user falls down, is struck suddenly by an object, etc. In this manner, an alarm signal is not sent out erroneously due to an incorrect judgment by the portable electrical apparatus 100.

In other words, after the micro-controller 120 determines that the sensing value corresponding to the sensing signal is greater than the threshold value, if the user remains at the same place within a predetermined period, such as 60 seconds or 120 seconds, the position data generated by the wireless positioning module 130 are the same (for example, the position data at the beginning and the end of the predetermined period are the same). Subsequently, the micro-controller 120 sends out the alarm signal to the wireless positioning module 130, and the wireless positioning module 130 sends out a wireless radio frequency signal corresponding to the alarm signal through the antenna 140. In this manner, when the user falls down, is struck suddenly by an object, etc. and is unable to move, the alarm signal will be sent out automatically, such that notification of the emergency condition of the user can be provided. In this embodiment, if at least half of or some of the loaded position data are the same (for example, 60% of the position data are the same), due to the tolerance range of data comparison, the micro-controller 120 may determine that the position of the user within the predetermined period is the same, and the micro-controller 120 will send out the alarm signal to the wireless positioning module 130.

If the user moves to another position within the predetermined period, then at least two position data loaded by the micro-controller 120 are different, and the micro-controller 120 may determine that the position of the user is different and hence that the user did not fall down, was struck suddenly by an object, etc. Therefore, an alarm signal is not sent out erroneously merely because the sensing value corresponding to the sensing signal is greater than the threshold value.

Subsequently, in step 280, a radio frequency signal corresponding to the alarm signal is sent out after the alarm signal is received. The radio frequency signal can be sent out to a server via the antenna 140.

Finally, in step 290, the warning signal corresponding the radio frequency signal is sent out to the Internet, so that the family members of the user and/or the care center can be made aware of the emergency situation.

In summary, the embodiments above utilize two conditions to determine whether to send out the alarm signal. The first condition is satisfied when the sensing value is greater than the threshold value, and the second condition is satisfied when the position data loaded within the predetermined period are the same. In this manner, an alarm signal is not sent out erroneously due to an incorrect judgment by the portable electrical apparatus 100.

When both of the conditions are satisfied, this indicates that the user has fallen down, has been struck suddenly by an object, etc. and is unable to move. Hence, the micro-controller 120 sends out an alarm signal to the wireless positioning module 130 automatically, and the wireless positioning module 130 sends out a radio frequency signal to a server. The server, in turn, may send out a warning signal to the Internet, such that family members of the user and/or the care center can be made aware of the emergency situation. Therefore, by utilizing the embodiments of the present invention, the safety of the user can be ensured more effectively than when using the conventional passive systems.

Although the present invention has been described in considerable detail with reference to certain embodiments thereof, other embodiments are possible. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A portable electrical apparatus comprising:

a sensor for sensing a movement of the portable electrical apparatus to generate a sensing signal;

a micro-controller for receiving the sensing signal and comparing a threshold value with a sensing value corresponding to the sensing signal; and a wireless positioning module coupled to the micro-controller, for performing localization of the portable electrical apparatus to generate a plurality of position data corresponding to a location of the portable electrical apparatus;

wherein when the sensing value is greater than the threshold value, the micro-controller loads the position data generated within a predetermined period starting from right after the sensing value is greater than the threshold value, the micro-controller compares the loaded position data with each other, and an alarm signal is sent out according to a comparison result, wherein when the micro-controller determines that all the loaded position data are the same, the wireless positioning module sends out the alarm signal.

2. The portable electrical apparatus of claim 1, wherein when the micro-controller determines that all the loaded position data are the same, the micro-controller sends out the alarm signal to the wireless positioning module.

3. The portable electrical apparatus of claim 1, wherein when the micro-controller determines that at least half of the loaded position data are the same, the micro-controller sends out the alarm signal to the wireless positioning module.

4. The portable electrical apparatus of claim 1, wherein the sensor is an accelerometer, and the wireless positioning module is a ZigBee® wireless positioning module.

5. A method for detecting a state of a portable electrical apparatus comprising:

performing localization of the portable electrical apparatus to generate a plurality of position data corresponding to a location of the portable electrical apparatus;

sensing a movement of the portable electrical apparatus to generate a sensing signal;

comparing a threshold value with a sensing value corresponding to the sensing signal;

loading the position data generated within a predetermined period when the sensing value is greater than the threshold value, wherein the predetermined period starts right after the sensing value is greater than the threshold value;

comparing the loaded position data with each other; and sending out an alarm signal when the loaded position data are the same.

6. The detecting method of claim 5 further comprising:

continuing to perform localization of the portable electrical apparatus when at least two loaded position data are different.

7. The detecting method of claim 5 further comprising:

sending out the alarm signal when at least half of the loaded position data are the same or part of the loaded position data are the same.

8. A method for detecting a state of a portable electrical apparatus comprising:

turning on the portable electrical apparatus;

performing localization of the portable electrical apparatus to generate a plurality of position data corresponding to a location of the portable electrical apparatus;

sensing a movement of the portable electrical apparatus to generate a sensing signal;

comparing a threshold value with a sensing value corresponding to the sensing signal;

loading the position data generated within a predetermined period when the sensing value is greater than the threshold value, wherein the predetermined period starts right after the sensing value is greater than the threshold value;

comparing the loaded position data with each other;

sending out an alarm signal when the loaded position data are the same;

sending out a radio frequency signal corresponding to the alarm signal; and sending out a warning signal corresponding to the radio frequency signal.

9. The detecting method of claim 8 further comprising:

sending out the alarm signal when at least half of the loaded position data are the same or part of the position data are the same.

* * * * *